US006907696B1

(12) United States Patent
Hutton

(10) Patent No.: US 6,907,696 B1
(45) Date of Patent: Jun. 21, 2005

(54) CAULK APPLICATION DEVICE

(76) Inventor: Allan Hutton, 1045 Creek Rd., Kitty Hawk, NC (US) 27949

( * ) Notice: Subject to any disclaimer, the term of this patent is extended or adjusted under 35 U.S.C. 154(b) by 0 days.

(21) Appl. No.: 10/163,656

(22) Filed: Jun. 5, 2002

(51) Int. Cl.[7] ..... E06B 1/04

(52) U.S. Cl. ..... 52/204.1; 49/469; 49/495.1; 156/250

(58) Field of Search ..... 49/469, 495.1, 49/475.1; 52/204.1, 204.5, 213, 208, 204.55, 52/214, 746.1, 741.4; 156/250, 71; 428/43

(56) References Cited

U.S. PATENT DOCUMENTS 2,560,308 A * 7/1951 Spraragen ..... 49/495.1
3,075,802 A * 1/1963 Lowe ..... 296/29
3,664,140 A * 5/1972 Shimizu ..... 405/1
4,204,373 A 5/1980 Davidson
RE30,930 E 5/1982 Trachtenburg et al.
4,409,283 A * 10/1983 Boyle, Jr. ..... 428/190
4,629,648 A 12/1986 Minick et al.
4,654,250 A 3/1987 Black et al.
4,709,624 A 12/1987 Croft
4,822,655 A 4/1989 Foster
5,218,793 A * 6/1993 Ball ..... 52/62

* cited by examiner

*Primary Examiner*—Korie Chan
(74) *Attorney, Agent, or Firm*—Coats & Bennett, P.L.L.C.

(57) ABSTRACT

A caulk application device for the installation of doorframes includes an adhesive mastic strip with at least one receptacle containing caulk affixed to the upper face thereof. The caulk receptacle may comprise two caulk-containing chambers separated by a seam of sufficient width to accept nails or staples. The device is applied to the subfloor within a rough opening, with the caulk receptacle aligned to the interior side and an opposite lip of the mastic protruding to the exterior. The ends are turned up at the corners of the rough opening. The device is secured to the subfloor by fasteners, preferably applied at the seam between caulk chambers. The caulk receptacle is opened, exposing the caulk, and the doorframe set in place, riding on the bed of caulk. The protruding lip of mastic is turned down over the exterior, and covered with siding or the like.

6 Claims, 3 Drawing Sheets

CAULK APPLICATION DEVICE

BACKGROUND OF THE INVENTION

The present invention relates generally to the field of construction and specifically to a device and method of applying caulk to a doorframe.

Improperly installed exterior doorframes—particularly in residential construction in coastal areas or hurricane zones—are responsible for substantial incursion of water into the interior of the associated buildings, resulting in significant damage. Accordingly, doorframes should properly be secured to the subfloor in a weatherproof manner upon installation.

One popular installation method uses a strip of mastic, or adhesive, between the lower edge of the doorframe and the subfloor. One problem with this method is that mastic is a strong and immediate adhesive. Once placed upon the mastic, the doorframe cannot be moved or shimmed to shift its position, level it, or make similar adjustments.

An alternative method commonly employed to secure the doorframe to the subfloor involves the use of caulk. Typically, one or two beads of caulk are hand-applied to either the subfloor or the lower edge of the doorframe using a conventional caulking gun, prior to setting the doorframe into place. While this method allows for subsequent adjustment of the doorframe within the rough opening, the amount of caulk dispensed is typically insufficient to properly seal the gap between the doorframe and the subfloor.

SUMMARY OF THE INVENTION

The present invention relates to a caulk application device. The device includes an adhesive member having an upper and lower face and a longitudinal extent, with at least the lower face thereof (and preferably additionally the upper face) being adhesive and covered with strippable protective covers. The caulk application device also includes at least one receptacle containing caulk affixed to the upper face, which may comprise two caulk-containing chambers separated by a seam of sufficient width to accept nails or staples. The caulk receptacle(s) may include a pull-tab and drawstring along with a perforated or otherwise weakened strip along the exposed surface, to facilitate opening to expose the caulk. Alternatively, they may include a line or other indicia indicating where the receptacle is to be cut.

The present invention additionally relates to a method of installing a doorframe in a rough opening. The lower face protective cover is removed from a caulk application device of the present invention, which is laid on the subfloor within the rough opening, with the caulk receptacle aligned with the interior edge. The caulk application device may be secured to the subfloor by fasteners, preferably applied at the seam between caulk chambers of the caulk receptacle. The device ends may be turned up at the corners of the rough opening. A lip opposite the caulk receptacle, protruding to the exterior of the building, may be cut at the corners, and folded down over the exterior, to be covered with siding or the like. The caulk receptacle is opened by actuation of a pull-tab or by cutting open a caulk chamber, exposing the caulk. The doorframe is then set in place, on a bed of caulk that substantially seals all voids between the lower face of the doorframe and the mastic material adhesively bound to the subfloor, and may subsequently be adjusted, shimmed, leveled, and the like.

DETAILED DESCRIPTION OF THE INVENTION

Figure 1:
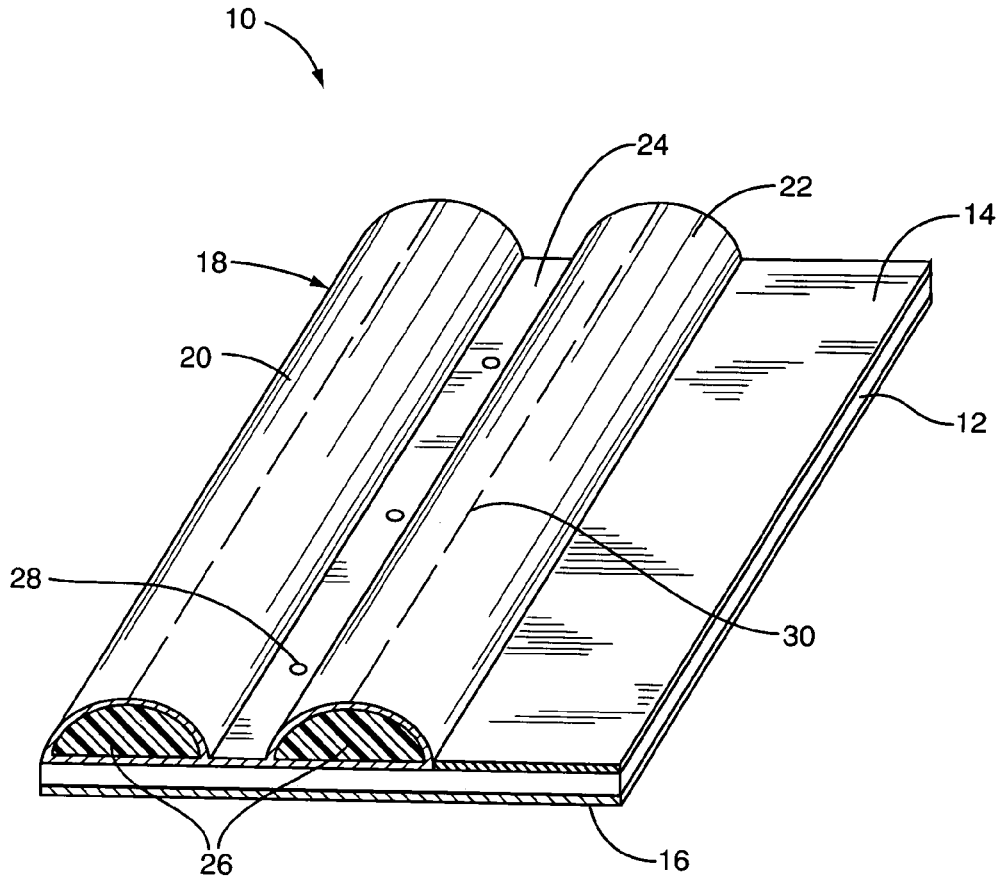
FIG. 1 is a perspective view of a section of a caulk application device of the present invention.

FIG. 1 depicts a caulk application device 10 according to the present invention. The caulk application device 10 comprises a strip of mastic 12, upon which is disposed at least one receptacle 18 containing caulk. The mastic strip 12 exhibits strong and immediate adhesive characteristics, at least on the lower face thereof, and preferably on both the upper and lower face. The lower face of the mastic strip 12 is covered with a strippable protective cover 16, such as a thin layer of plastic, wax paper, or the like. The protective strip 16 facilitates the handling of the mastic strip 12, and protects the adhesive lower face thereof from contamination by dirt and the like.

Affixed to the upper face of the mastic strip 12, positioned adjacent one side thereof, and extending longitudinally substantially the entire length of the mastic strip 12 is at least one receptacle 18 containing caulk 26. In a preferred embodiment, the receptacle 18 comprises two longitudinal chambers 20 and 22, spaced apart from each other, and each containing caulk 26. The chambers 20, 22 may be formed, for example, from a single tube or cylinder of plastic, rubber, or similar suitable material, and divided into two chambers 20, 22 by a central seam 24. The seam 24 may be formed by heat sealing, adhesive, or other suitable means. Alternatively, the two chambers 20, 22 and intervening seam 24 may be formed as an assembly, such as by extrusion, molding, or other means as are well known in the art.

Figure 2:
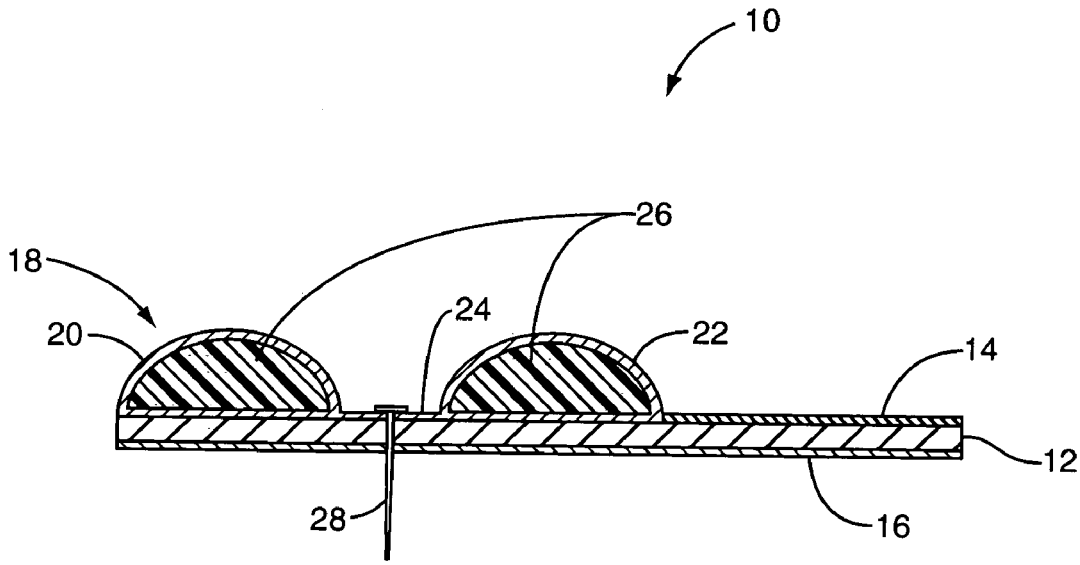
FIG. 2 is a side section view of the caulk application device of the present invention.

The caulk receptacle 18 is affixed to the upper face of the mastic strip 12, oriented in a longitudinal direction, and adjacent one edge thereof. In a preferred embodiment, the mastic strip 12 exhibits adhesive qualities on the upper face thereof as well as the lower face, and the caulk receptacle 18 is affixed to the upper face of the mastic strip 12 via the adhesive action of the mastic strip 12. In this case, a protective cover 14 covers the portion of the mastic strip 12 left exposed. Alternatively, the caulk receptacle 18 may be affixed to the mastic strip 12 by conventional means, such as heat sealing, adhesive, or other suitable means. Upon being affixed to the upper face of the mastic strip 12, the caulk receptacle chambers 20 and 22 will preferably assume a generally half-cylindrical or half-elliptical cross-section, as depicted in FIG. 2. The caulk receptacle chambers 20 and 22 are sealed at either end, to contain the caulk 26.

In a preferred embodiment, the exposed surface of the caulk receptacle 18, or the caulk-filled chambers that comprise it—and preferably the center or uppermost portion—includes an easy-opening mechanism, such as a pull-tab or drawstring 21. The pull-tab or drawstring 21 preferably operates in conjunction with a weakened structural zone of the receptacle 18, such as a perforated or partially perforated strip 23, a weakened area of plastic, or the like, to facilitate the opening of the receptacle 18 upon actuation of the drawstring 21 or pull-tab. Alternatively, the receptacle 18 may be marked with a line or similar indicia 30 on the exposed surface thereof (and preferably in the center thereof) to indicate where the receptacle 18 may be cut open to expose the caulk 26.

In a preferred embodiment, wherein the mastic strip 12 exhibits adhesive properties on both the lower and upper face thereof, the portion of the upper face of the mastic strip 12 that is not covered by the caulk receptacle 18 is covered with a strippable protective cover 14. The protective cover 14 is substantially similar to the protective cover 16 applied to the lower face of the mastic strip 12. The protective cover 14 facilitates the handling and storage of the caulk application device 10, and protects the exposed adhesive upper face of the mastic strip 12 from the accumulation of dirt and the like.

The caulk application device 10 is preferably formed in lengths sufficient to facilitate the installation of standard residential doorframes. The caulk application device 10 may thus be formed in approximately 42-inch lengths for a standard single door, although other lengths are possible within the scope of the present invention. By pre-forming the caulk application device 10 in a length slightly greater than the width of a standard door frame, several inches on either end may be turned up, along the sides of the rough opening, to ensure proper caulking not only across the entire lower extent, but additionally around the lower corners, of the door frame. The mastic strip 12 is preferably approximately 6 inches wide, a dimension that also exceeds the standard residential doorframe. As described below, this excess width additionally facilitates sealing of the doorframe against water incursion.

In use, when a doorframe is ready to be installed in a rough opening, the protective cover 16 is removed from the lower face of the mastic strip 12 and discarded. The caulk application device 10 is laid on the subfloor in the rough opening, with the caulk receptacle 18 flush with the interior side of the rough opening, and the opposite edge of the mastic strip 12 protruding to the exterior of the building. The caulk application device 10 is generally centered across the width of the rough opening, with the edges turned up at the corners on either side. The adhesive action of the lower face of the mastic strip 12 secures the caulk application device 10 to the subfloor as soon as it is positioned in the rough opening and pressed into place. Additionally, the caulk application device 10 may be secured to the subfloor by conventional fasteners 28, such as nails, screws, staples, or the like. The fasteners 28 are preferably applied through the seam 24 between the two caulk-filled chambers 20 and 22 (which are spaced apart to a degree sufficient to facilitate e.g., the hammering of a nail 28 therebetween).

The caulk receptacle 18 is then opened, exposing the caulk contained therein. This may comprise pulling a pull-tab or string, if provided, or alternatively may simply comprise cutting along the top of the receptacle 18, such as with a utility knife, box cutter or similar implement. If the caulk receptacle 18 lacks a perforated seam or pull-tab, it may be marked with a "cut here" line or similar indicia 30. The doorframe is then set in place in the rough opening. At this point, the doorframe rests on a thick bed of caulk exposed by opening the caulk receptacle 18. The caulk substantially seals all voids between the mastic strip 12 and the lower edge of the doorframe. In this manner, the paucity of caulk typically employed in sealing the doorframe to the subfloor, due to inexperience or an attempt to reduce cost, is avoided, and a sufficient amount of caulk is necessarily applied. After setting it in place, the doorframe may be freely shifted, adjusted, shimmed, leveled, and the like, and then secured to the subfloor and rough opening jambs in a conventional manner.

In a preferred embodiment, the width of the caulk application device 10 of the present invention exceeds the jamb width of the rough opening of a standard residential doorway. As described, the caulk application device 10 is placed in the rough opening with the caulk receptacle 18 aligned with the interior edge. This leaves an edge, or lip, of the mastic strip 12 protruding to the exterior of the building. The protruding lip of the mastic strip 12 may be cut at either corner of the doorframe (where it turns up along the sides), and folded down over the building exterior. When siding or other covering is applied to the exterior of the building, the upper face protective strip 14 is removed, exposing the adhesive upper face of the mastic strip 12, which facilitates the secure attachment of the siding. The folded-down lip of mastic prevents water from seeping under the mastic strip 12 (i.e., between the subfloor and the lower face of the mastic strip 12). The thick bed of caulk exposed by opening the caulk receptacle 18 substantially seals the space between the lower edge of the doorframe and the upper face of the mastic strip 12 against the incursion of water. Thus, the doorframe is completely and properly weather-sealed, curing a major source of water incursion damage. The use of the caulk application device 10 ensures a proper water-tight seal, regardless of the skill, experience, or craftsmanship of the worker installing the door frame.

Figure 3:
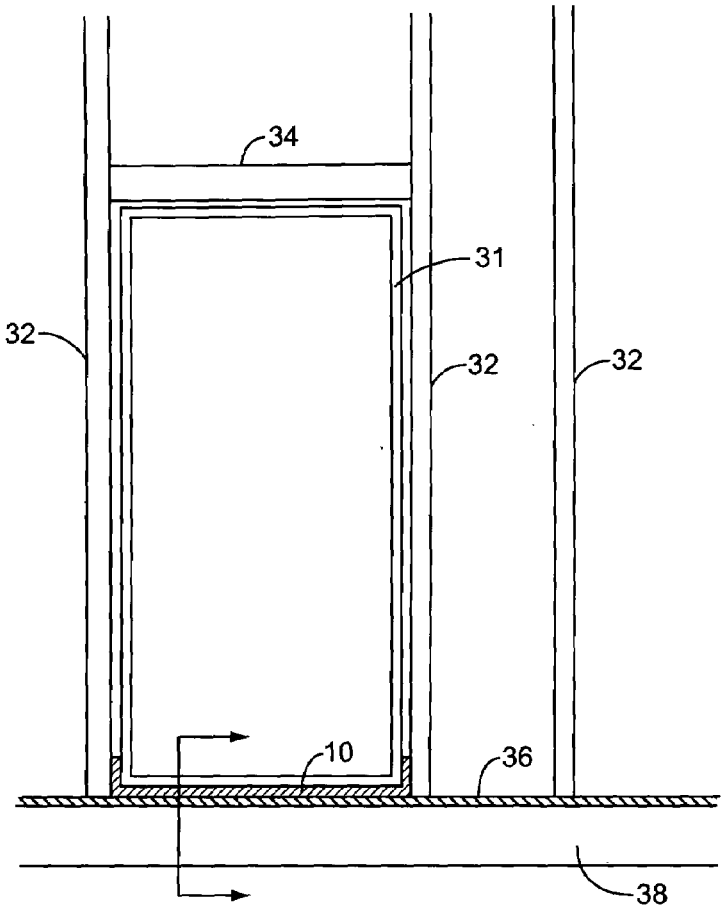
FIG. 3 depicts a door assembly, including a rough opening with a doorframe installed therein.

FIG. 3 depicts a representative doorframe 31 installed in a rough opening formed from framing studs 32 and head-piece 34, which are conventional elements of residential construction, and may for example comprise 2×4's. The doorframe 31 normally rests on the subfloor 36, which may for example be formed from plywood. The subfloor 36 in turn rests on framing member 38, which may for example be a 2×6 or other size board, as appropriate. According to the present invention, the caulk application device 10 is interposed between the lower edge of the doorframe 31 and the subfloor 36, releasing caulk 26 to substantially fill all voids beneath the lower edge of the doorframe 31. Note that the edges of the caulk application device 10 are turned up against the jamb of the rough opening on either side, as described above.

Figure 4:
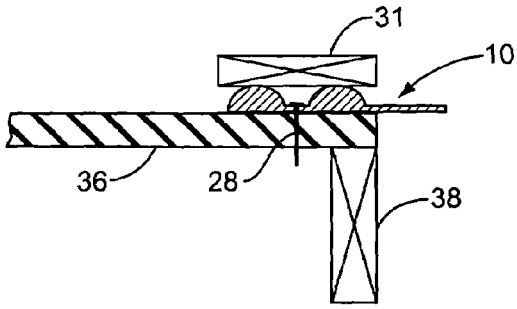
FIG. 4 is a sectional view of the lower portion of the doorframe with the caulk application device of the present invention.

FIG. 4 is a sectional diagram, taken along the section lines indicated in FIG. 3, depicting the relationship between the lower edge of the doorframe 31, the caulk application device 10, and the subfloor 36. The caulk application device 10 is secured to the subfloor 36 by the adhesive action of the mastic strip 12, and additionally by fasteners 28. Note that FIG. 4 depicts the chambers 20, 22 of the caulk receptacle 18 prior to opening. In practice, the chambers 20, 22 would be opened to expose the caulk 26 prior to setting the doorframe 31 in place over the caulk application device 10. The portion of the mastic strip 12 protruding to the exterior of the building may be turned down and secured to the subfloor and framing member 38, as described above, further protecting the building from the incursion of water at the doorway.

Although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the scope of the invention. The present embodiments are therefore to be construed in all aspects as illustrative and not restrictive and all changes coming within the meaning and equivalency range of the appended claims are intended to be embraced therein.

What is claimed is:

1. A method of installing a doorframe in a rough opening, comprising:

securing to a subfloor in said rough opening, in a transverse direction, a caulk application device comprising an adhesive member having an adhesive lower face and at least one receptacle containing caulk affixed to an upper face thereof;

opening said receptacle to expose said caulk; and thereafter installing said doorframe on said device, such that said exposed caulk contacts said doorframe substantially continuously across the transverse extent thereof.

2. The method of claim 1 further comprising securing said caulk application device to said subfloor with a plurality of fasteners prior to installing said doorframe.

3. The method of claim 2 wherein said fasteners include those selected from the group including nails, staples, and screws.

4. The method of claim 2 wherein said at least one receptacle comprises two spaced apart chambers, and said fasteners are applied between said spaced apart chambers.

5. The method of claim 1 further comprising removing a protective strip from a lower face of said caulk application device prior to securing said device to said subfloor.

6. The method of claim 1 further comprising adjusting the position of said doorframe in said rough opening prior to said caulk curing.

* * * * *